US007524601B2

(12) United States Patent
Hayashi et al.

(10) Patent No.: US 7,524,601 B2
(45) Date of Patent: Apr. 28, 2009

(54) TONER AND METHOD OF MANUFACTURING THE TONER

(75) Inventors: Kenji Hayashi, Hachioji (JP); Mikio Koyama, Kunitachi (JP); Meizo Shirose, Hachioji (JP); Makoto Nomiya, Tokyo (JP)

(73) Assignee: Konica Minolta Business Technologies, Inc. (JP)

( * ) Notice: Subject to any disclaimer, the term of this patent is extended or adjusted under 35 U.S.C. 154(b) by 455 days.

(21) Appl. No.: 11/346,872

(22) Filed: Feb. 2, 2006

(65) Prior Publication Data

US 2006/0194135 A1 Aug. 31, 2006

(30) Foreign Application Priority Data

Feb. 4, 2005 (JP) ..... 2005-028646

(51) Int. Cl.
*G03G 9/00* (2006.01)

(52) U.S. Cl. ..... 430/108.4; 430/110.2

(58) Field of Classification Search ..... 430/108.4, 430/110.2

See application file for complete search history.

(56) References Cited

U.S. PATENT DOCUMENTS 6,100,312 A * 8/2000 Suzuki et al. ..... 522/6

FOREIGN PATENT DOCUMENTS

| | | |
|---|---|---|
| JP | 04-372958 | 12/1992 |
| JP | 07-271101 | 10/1995 |
| JP | 10-046498 | 2/1998 |
| JP | 10-282730 | 10/1998 |
| JP | 11-044966 | 2/1999 |
| JP | 2000-214629 | 8/2000 |
| JP | 2001-305798 | 11/2001 |
| JP | 2005-280303 | 10/2005 |
| WO | WO 2004/031865 | 4/2004 |

OTHER PUBLICATIONS

JP Office Action for Appl. 2006-024283, mailed May 20, 2008, 3 pgs.
Translation of JP Office Action for Appl. 2006-024283, mailed May 20, 2008, 3 pgs.

* cited by examiner

*Primary Examiner*—Mark A Chapman
(74) *Attorney, Agent, or Firm*—Squire, Sanders & Dempsey L.L.P.

(57) ABSTRACT

A toner is disclosed, comprising a resin (A), a colorant (B) and an alkylidenecarboxylic acid (C).

18 Claims, 3 Drawing Sheets

TONER AND METHOD OF MANUFACTURING THE TONER

BACKGROUND

1. Technical Field

The present invention relates to a toner used for image formation in electrophotographic systems and a preparation method thereof, and in particular to a toner capable of stably forming toner images on paper-used for off-set printing and a preparation method thereof.

2. Related Art

Recently, in the field of imaging technology of electrophotographic systems employing copiers or printers, there has been demand for a technology at a level of precise reproduction of minute dot images at a level of 1200 dpi (dpi: the number of dots per inch or 2.54 cm) along with advancement of digital technologies. Accordingly, reduction of toner particle size has been accelerated and development of a fine-particulate toner has become feasible through chemical toners, also called polymerization toners, leading to faithful reproduction of minute dot images, as described in JP-A No. 2000-214629 (hereinafter, the term, JP-A refers to Japanese Patent Application Publication).

As a result, there has become feasible high-precise image formation of an offset printing level. In addition thereto, rapid accessability capable of achieving print-making without necessity of making a printing plate has expanded business opportunities. Recently, competition with offset printing has kicked off in parts of the field of commercial shortrun printing, as described, for instance, in JP-A No. 2001-240301.

However, an offset printing system and an electrophotographic system differ greatly in design of output paper. For example, paper used for an electrophotography system is designed so as to control resistivity and exclude moisture absorption to attach much importance to electrostatic transferability. On the contrary, paper used for offset printing is designed to enhance affinity to water so as to have the right amount of an aqueous dampening liquid. Accordingly, there was conducted development of paper for offset printing which is also usable in electrophotographic imaging. For instance, paper used for offset printing was proposed, in which an improvement of binding property of cellulose fibers using a water-resistance agent or a water-soluble polymer enabled its use in toner image formation, as described in JP-A No. 10-46498.

However, it was proved that subjecting offset printing paper to a heat treatment caused the variation of the moisture content within the paper, often resulting in curling or a phenomenon such as water vapor blowout at a microlevel, called toner blister. This phenomenon is markedly observed in non-coated paper which was not subjected to a surface treatment. This is due to effects of a hydrophilic compound such as a cationized starch or polyvinyl alcohol which is incorporated to maintain strength of paper fibers.

Glossy coated paper has a glossy surface layer formed of wax exhibiting a melting point of 100 to 160° C. of resin emulsion such as polyacrylamide, so that the surface layer is easily destroyed upon heating at the time of fixing, often resulting in markedly deteriorated glossiness of the white background.

The foregoing problems can be overcome by the use of output paper suitable for each image formation. However, it is not desirable for printing dealers that usable paper is limited by a used apparatus and it rather becomes a barrier blocking printing business.

An electrophotographic image forming technology which can use even offset printing paper, was proposed so that there was desired a toner which can be fixed at a temperature inhibiting generation of water vapor, that is a temperature of less than 100° C. Image formation on both sides of paper is often conducted specifically in the commercial printing field, so that there is desired a toner exhibiting superior image storage stability without causing staining between adjacent printed materials.

SUMMARY

One aspect of the invention is directed to a toner containing a resin (A), a colorant (B) and alkylidenecarboxylic acid (C).

In the aspect of the invention, there can be provided a toner which can stably perform electrophotographic image formation on offset printing paper. Specifically, it is fixable at a temperature of less than 100° C. with inhibiting the image defect, so-called toner blister, which is due to water vapor generation during fixing. In the aspect of the invention, it is feasible to inhibit curling after fixing and also causing no change in glossiness of the white background even when glossy coated paper is subjected to heat-fixing. Further, in the aspect of the invention, there can be provide a toner which can achieve stable image formation even in a high humidity environment under which toner transfer onto offset printing paper is specifically difficult, and there can also be provided a toner which can smoothly perform an on-demand type binding work without causing printed materials to stain each other when printed on both sides of printing paper.

BRIEF EXPLANATION OF THE DRAWINGS

The present invention will become more fully understood from the detailed description given herein below and the accompanying drawings which are given by way of illustration only, and thus are not intended as a definition of the limits of the present invention, and wherein.

DETAILED DESCRIPTION OF THE PREFERRED EMBODIMENTS

Figure 1:
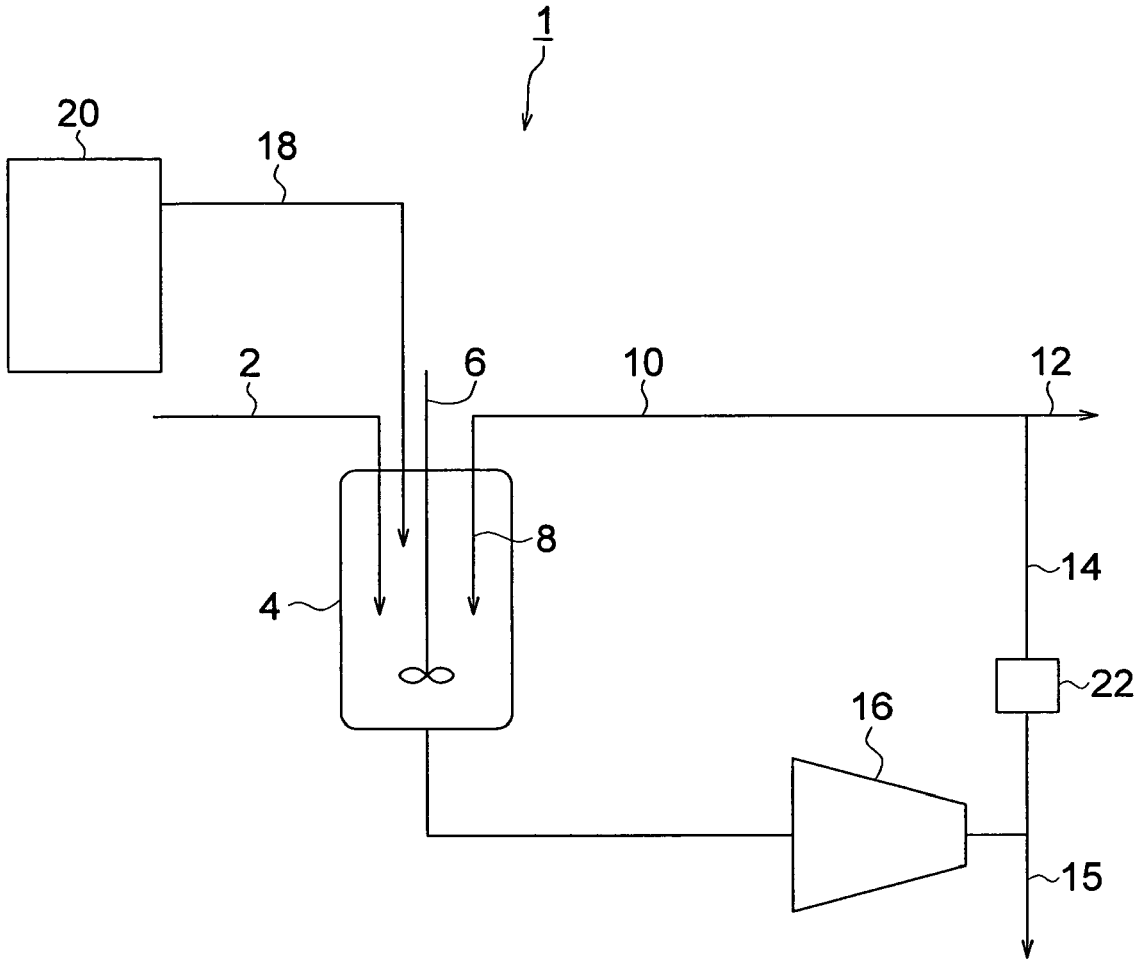
FIG. 1 illustrates an example of a reaction apparatus used for polymerization of vinyl polymer (D).

One aspect of the invention is directed to a toner containing a resin (A), a colorant (B) and alkylidenecarboxylic acid (C).

The present invention has come into being as a result of discovery by the inventors of this application that containing alkylidenecarboxylic acid (C) in a toner lowers a fixing temperature, leading to markedly enhanced storage stability at ordinary temperature and image fastness.

The mechanism thereof is not definite but it is assumed that an alkylidenecarboxylic acid penetrates into a molecular chain of a resin constituting a toner, promoting a micro-Brownian movement, thereby reducing a heat quantity provided by a fixing unit. Specifically, in the case of the resin (A) containing an ester group, it is contemplated that a carboxylic acid of an alkylidenecarboxylic acid (C) forms a hydrogen bond with the eater group contained in the resin (A), inhibiting bleed-out of the alkylidenecarboxylic acid (C) at ordinary temperature. Accordingly, a resin (A) is preferably one containing an ester group.

In the foregoing aspect of the invention, it is preferable that a toner contains vinyl polymer (D). It is also preferred to contain a releasing agent (E) in a toner.

There will be further described details.

Resin (A) [hereinafter, also denoted as binding resin (A)] and vinyl polymer (D) contained in the toner of this invention, each preferably has a polar group. Specific examples of a polar group include a carboxyl group, an ester group, an ether group, a hydroxyl group, an amide group, an imide group, a nitro group, an amino group, an ammonium group, a sulfonyl group, a thio group and a sulfide group. A group having conjugated π-electrons is also included in the polar group of this invention and examples thereof include ones having an aromatic structure, such as a phenyl group or a naphthyl group. Of these polar groups, a carboxyl group, ester group, ether group and hydroxyl group are preferred. The carboxyl group may form a metal salt. A preferred metal is an alkali metal, an alkaline earth metal, aluminum or zinc. A polar group is preferably a carboxyl group, an ester group or hydroxy group.

In this invention, a releasing agent (E) (hereinafter, also denoted simply as a releasing agent) contained in the toner is preferably nonpolar. Herein, the expression, being nonpolar means that the value of Y/X is from 0 to 0.05 wherein X is the number of carbon atoms included in the molecule of a releasing agent and Y is the number of heteroatoms other than carbon and hydrogen atoms. Specific examples of a nonpolar structure include a structure of a hydrocarbon, such as an alkane or an alkene.

A binding resin (A) is preferably a vinyl resin formed of radical polymerization (addition polymerization). In addition, there are also usable condensation polymers, such as a polyester resin and a polyol resin. The binding resin (A) may be one which is formed of a single kind of a monomer but one which is formed of plural kinds of monomers, is preferred.

Radical-polymerizable monomers usable in this invention include, for example, an aromatic type vinyl monomer, an acrylic acid ester type vinyl monomer, a methacrylic acid ester type vinyl monomer, and a vinyl ether type monomer. Examples of an aromatic type vinyl monomer include a styrene monomer, which is comprised of a side chain having a conjugated π-electron structure, and its derivatives. Examples of an acrylic acid ester type vinyl monomer and a methacrylic acid ester type vinyl monomer include methyl acrylate (or acrylic acid methyl), ethyl acrylate, butyl acrylate, 2-ethylhexyl acrylate, cyclohexyl acrylate, phenyl acrylate, benzyl acrylate, methyl methacrylate, ethyl methacrylate, butyl methacrylate, hexyl methacrylate, 2-ethylhexyl methacrylate, cyclohexyl methacrylate, benzyl methacrylate, ethyl β-hydroxyacrylate, propyl γ-aminoacrylate, stearyl methacrylate, dimethylaminoethyl methacrylate, and diethylaminoethyl acrylate.

Crosslinking agents may be incorporated into the binding resin (A) to enhance desired characteristics of a toner. Such crosslinking agents include those which contain at least two unsaturated bonds, for example, divinylnaphthalene, divinyl ether, diethylene glycol methacrylate, ethylene glycol methacrylate, polyethylene glycol dimethacrylate and diallylphthalate.

In this invention, there may be used a polymerizable monomer containing a dissociative group and a polymerizable monomer containing a basic group to form a resin (A). Examples of a monomer containing a dissociative group include a carboxyl group-containing monomer and a sulfonic acid group-containing monomer. Examples of a monomer containing a basic group include amine compounds such as a primary amine, secondary amine, tertiary amine and quaternary ammonium salt. Examples of a carboxyl group-containing monomer include acrylic acid, methacrylic acid, fumaric acid, maleic acid, itaconic acid, cinnamic acid, monobutyl maleate, and monooctyl maleate. These may be in the form of an alkali metal salt such as sodium or potassium or an alkaline metal salt such as calcium. Examples of a monomer containing a basic group include dimethylaminoethyl acrylate, dimethylaminoethyl methacrylate, diethylaminoethylethyl acrylate, diethylaminoethyl methacrylate and quaternary ammonium salts of the foregoing four compounds.

To bring out advantageous effects of the invention, the number of carbon atoms of an alkylidenecarboxylic acid is preferably 4 to 12, and more preferably 5 to 8. The number of carbon atoms is inclusive of a carbon atom of a carboxyl group. An alkylidenecarboxylic acid is preferably an alkylidene acetic acid, and more preferably isobutylideneacetic acid. The carboxyl group of the alkylidenecarboxylic acid may form a metal salt. A preferred metal is an alkali metal, an alkaline earth metal, aluminum or zinc. As a metal, an alkali metal is preferred. It is preferable that alkylidenecarboxylic acid does not form metal salt.

An alkylidenecarboxylic acid is contained preferably in an amount of 0.0002% to 0.5% by weight of the toner, and more preferably 0.0004% to 0.016%. Such a content of an alkylidenecarboxylic acid is contemplated to achieve stable toner transfer in image formation on offset printing paper under high temperature and high humidity. An alkylidenecarboxylic acid is contained in the toner preferably by addition to the vinyl polymer (D) in the process of manufacturing the toner, but may be added with the binding resin (A) and a colorant.

The content of an alkylidenecarboxylic acid can be determined by the head space GC/MS method. Recovery into TENAXTA is performed for 30 min. using helium gas at 100 ml/min. The amount of an alkylidenecarboxylic acid is determined in a purge & trap GC/MS method, as a converted value, based on the calibration curve of hexadecane. Details thereof are as follows:

Recovery Condition:
out-gas collecting device: HM-04GW type
vessel volume: 160 ml
90° C., He 100 ml/min, 30 min., recovery into TENAX TA
sample amount 10 mg Detailed Conditions for Purge & Trap GC/MS Measurement:
TFER HEATER: 250° C.
NEEDLE HEATER: 250° C.
SAT HEATER: 200° C.
SAT: TENAX TA (F280, L10 MM)
HEAD PRESS.: 117 Kpa
COLUMN FLOW: 2.0 ml/min
SPLIT RATE: 1/GC-OVEN TEMP.: 40° C. (3 min)-(10° C./MIN)−280° C. (3 min)
DET. TEMP.: 260° C.
ANA. TIME: 30 min GCMS-QP MASS RANGE: 40-800
SCAN TIME: 30 min
EM-0.75 Kv
column: db-5 ms: 0.25 mm×30 M, t 0.25 μm
SAT:TENAX TA(F280, L10 mm)
HEAD PRESS.: 117 Kpa
COLUMN FLOW: 2.0 ml/min.

In the invention, addition of vinyl polymer (D) to the toner is preferred. The vinyl polymer (D) used in this invention is one which exhibits a glass transition temperature of −100° C. to 20° C. and a peak molecular weight of 330 to 3400. It is preferred that the glass transition temperature of the vinyl polymer (D) is lower by 10 to 150° C. than the resin (A) and that the molecular weight distribution of the vinyl polymer is sharper (or narrower) than that of the resin (A).

Representative examples of the vinyl polymer (D) include (meth)acrylic acid ester polymer and (meth)acrylic acid ester-styrene copolymer. Examples of a polymerizable monomer constituting a vinyl polymer (D) include acrylic acid ester monomers such as butyl acrylate, decyl acrylate; octyl acrylate, 2-ethylhexyl acrylate and phenyl acrylate; and methacrylic acid ester monomers such as octyl methacrylate and decyl methacrylate. Of these monomers, butyl acrylate and 2-ethylhexyl acrylate are preferred.

The vinyl polymer (D) preferably contains a poly(acrylic acid alkyl ester) or poly(methacrylic acid alkyl ester) in an amount of at least 50% by weight, in which the alkyl has 4 to 15 carbon atoms (preferably 4 to 12 carbon atoms, and more preferably 4 to 10 carbon atoms). Examples of such a poly (acrylic acid alkyl ester) or poly(alkyl acrylate) include poly (butyl acrylate) and poly(2-ethylhexyl acrylate). A vinyl polymer (D) having such a structure exhibits a lower glass transition temperature (Tg) and is preferred for lowering the lowest fixing temperature of a toner. These poly(alkyl acrylate) compounds result in stronger adhesion together with a paper-strengthening agent such as cationic starch or polyacryl amide, leading to enhanced fixing strength.

As described above, when toner image formation is conducted using offset printing paper, for instance, glossy coated paper, a glossy layer provided on the paper surface is easily ruptured upon heating during fixing. In offset printing paper, inclusive of noncoated paper, hydrophilicity is required and a hydrophilic compound such as cationic starch or polyvinyl alcohol is incorporated to maintain strength between paper fibers. As a result, existence of the hydrophilic compound easily causes the moisture content of the paper to vary, affecting electric resistance of the paper.

In the invention, there can be provided a toner which is fixable at a low temperature at a level of not more than the boiling point of water in the fixing stage necessitating heating and which is also stably transferable onto paper provided with hydrophilicity.

The reason for the toner of the foregoing constitution overcoming the problems of this invention is contemplated that when the vinyl polymer described above is incorporated into a toner, the vinyl polymer is optimally dispersed within the toner without bleeding out on the toner particle surface, whereby the toner can be fused even at a low temperature.

It is preferred for storage stability that the vinyl polymer (D) is contained in the core portion and does not exist on the toner particle surface. Accordingly, it is preferred that a core portion containing a vinyl polymer (D) is formed and then, resin particles (s), not containing a vinyl polymer (D) are adhered to the periphery of the core portion to form a shell layer. The shell layer is a resin layer forming the outer layer of toner particles. Resin particles (s) are added to an aqueous medium including core portion particles and allowed to coagulate around the core portion and to be fused to form a shell layer.

The toner of this invention contains a vinyl polymer (D) preferably in an amount of from 0.1 to 20 parts by weight and more preferably from 2 to 15 parts by weight, based on 100 parts by weight of resin (A), in terms of fixability and image fastness of two-sided printing.

Vinyl polymer (D) is obtained, for example, via the following reaction process, one aspect of which concerns a process of supplying a polymerizable monomer to a reaction vessel. Thus, in the process of forming a vinyl polymer (D), first, a polymerizable monomer is fully filled in a reaction vessel and then, polymerization is started. At an arbitrary stage in which the reaction is in progress, a reaction product produced in the reaction vessel (which is a mixture Of a polymerized material and an unreacted monomer) is passed through a volatile component separator to separate volatile components such as unreacted monomer from the reaction product. Thereafter, the volatile component separated in the separator is again returned to the reaction vessel and the polymerization reaction is further continued, then, a final product is separated to obtain vinyl polymer (D).

Thus, the vinyl polymer (D) is prepared in such a manner that a polymerizable monomer is filled within the full-volume (100%) of the reaction vessel, then, the polymerization reaction is started and continued, while the monomer and a reaction product being filled in the full-volume of the reaction vessel. In the course of polymerization reaction of vinyl polymer (D), a reaction product (a mixture of the unreacted monomer and a polymerized material) is passed through a volatile component separator to recover the unreacted monomer in the reaction product. The recovered monomer is returned to the reaction vessel so as to be used in the polymerization for the vinyl polymer (D).

FIG. 1 illustrates a reaction apparatus used for polymerization of vinyl polymer (D). In FIG. 1, numeral 2 designates a line for supplying reaction components such as an initiator or solvents, other than a polymerizable monomer, numeral 4 designates a stirring vessel (reactor) for undergoing polymerization reaction, numeral 6 designates a stirrer, numeral 8 designates a line for supplying reuse material, numerals 10, 14 and 15 designate a conduit, numeral 12 designates a removal conduit, numeral 16 designates a volatilizing machine for allowing reaction product to pass through to remove and recover a volatile component, numeral 18 designates a supplying line of a polymerizable monomer, numeral 20 designates a supplying vessel for the polymerizable monomer, and numeral 22 designates a coagulator. The stirring vessel (reactor) 4 can be controlled so as to choose appropriate reaction conditions to obtain the intended vinyl polymer.

One or more kinds of polymerizable monomers are supplied from the monomer supplying vessel 20 to the stirring vessel (reactor) 4 provided with stirrer 6 through the monomer supplying line 18. Reaction components such as a free radical polymerization initiator or a solvent are also supplied to the stirring vessel (reactor) 4 through the line 2 to enable to start polymerization reaction. The start of polymerization is performed preferably by heating but is not limited to this. A chain-transfer agent can also be supplied to the stirring vessel (reactor) 4 through the line 2.

When the polymerization reaction has proceeded to a certain extent, the reaction mixture is supplied from the stirring vessel (reactor) 4 to the volatilizing machine 16 to separate and remove volatile components from the vinyl polymer product. The reaction mixture is passed through the volatilizing machine 16 to perform removal and recovery of the volatile components. Concurrently, the vinyl polymer product is recovered as a desired final product through the conduit 15 to be subjected to a treatment. Volatile components are condensed in the condenser 22 and the distillate is supplied to the stirring vessel type reactor 4 through the reuse material supplying line 8 via conduit 14 and conduit 10. Alternatively, the distillate is removed from the reaction system through removal conduit 12.

The glass transition temperature of a vinyl polymer (D) is from −100° C. to 20° C., preferably from −85° C. to 6° C. and more preferably from −80° C. to −20° C. The glass transition temperature can be determined using a combined system of DSC-7 differential scanning calorimeter (produced by Perkin Elmar) and TAC7/DX thermal analysis apparatus controller (also produced by Perkin Elmar). The measurement procedure by using the DSC-7 differential scanning calorimeter is as follows. A liquid nitrogen unit for cooling is installed, and a sample for measurement is accurately weighed to two places of decimals, enclosed in an aluminum pan "KIT No. 0219-0041" and set onto a sample holder. An empty aluminum pan is used as reference. Measurement is conducted in the temperature range of from −150° C. to 50° C. at a temperature-increasing rate of 10° C./min by the temperature control of Heat-Cool-Heat (i.e., a temperature control method in which heating and cooling are conducted within the above-described temperature range, and thereafter, heating is again conducted). The glass transition temperature is determined from an inflection point of the base line at the time of the second heating.

The peak molecular weight of a vinyl polymer (D) is from 330 to 3400, preferably from 800 to 2200, and more preferably from 1000 to 1800. The peak molecular weight may be based on either weight-average molecular weight (Mw) or number-average molecular weight (Mn).

The weight-average molecular weight (Mw) of a vinyl polymer (D) is preferably from 840 to 5200. The ratio of weight-average molecular weight (Mw) to number-average molecular weight (Mn), i.e., Mw/Mn is preferably from 1.2 to 2.4, and more preferably from 1.4 to 1.9.

The peak molecular weight can be determined by gel permeation chromatography (GPC). Molecular weight determination by GPC is conducted using tetrahydrofuran as a solvent and columns which are 3-4 connected columns of Tskgel G2000 (exclusion limit: 10000, produced by TOSO Co., Ltd.).

The toner of this invention preferably contains a releasing agent (E) at 1% to 30% (more preferably 2% to 20%, and still more preferably 3% to 15%) by weight of the toner.

A releasing agent used in this invention is a compound which prevents fusion of a toner onto a fixing member or prevents occurrence of toner off-set. Thus, the releasing agent has a property of forming liquid membrane between a fixing member and the toner image. Specific examples thereof include chained hydrocarbon compounds such as polypropylene and polybutene, or commonly named paraffin wax, microcrystalline wax, Fischer-Tropsch wax, and α-polyolefin wax. There is also usable a fatty acid or its ester satisfying the requirement of Y/X being not more than 1/20, in which X is the number of carbon atoms and Y is the number of oxygen atoms. Polyhydric alcohols or polycarboxylic acids are used for esterification.

In this invention, a layer of a releasing agent (E) having no polar group is formed on a part of or whole the toner image surface. The thus formed releasing agent (E) layer covers the toner image, whereby vinyl polymer (D) contained in the toner is inhibited to move from one image to another image (bleeding). As a result, even when printed sheets having toner images on both sides, are piled or tied, toner staining of adjacent sheets does not result.

The toner of this invention contains a colorant (B) preferably in an amount of from 1% to 30% by weight, more preferably from 2% to 20% and still more preferably from 3% to 15%. Conventionally known inorganic or organic colorants are usable as the colorant (B).

Black pigments such as carbon black, iron oxide and titanium black and dyes such as Nigrosine are usable as a colorant for a black toner. Colorants used for a yellow toner include, for example, dyes such as C.I. Solvent Yellow 162 and pigments such as C.I. Pigment Yellow 14, the said 74, the said 93, and the said 138. Colorants used for a magenta toner include, for example, pigments such as C.I. Pigment Red 5, the said 48:1, the said 53:1, the said 57:1, the said 122, the said 139, the said 144, the said 149, the said 166, the said 177 and the said 184; C.I. Pigment Orange 31 and the said 43. Colorants used for a cyan toner include, for example, pigments such as C.I. Pigment Green 7; C.I. Pigment Blue 15:3 and the said 60. A mixture of the foregoing colorants is usable as a colorant of a special color. The number-average primary particle size of a dye or pigment, depending on the kind thereof, is preferably from 10 to 200 nm.

Next, charge control agents and external additives used for the toner of this invention will be described hereinafter.

Charge control agents or external additives may optionally be incorporated into the toner of this invention. There are usable compounds conventionally known as a charge control agent. Specific examples thereof include Nigrosine type dyes, metal salts of naphthenic acid or higher fatty acids, an alkoxylated amine, and a salicylic acid metal salt or its metal complex. As an included metal are cited Al, B. Ti, Fe, Co and Ni. The content of a charge control agent is preferably from 0.1% to 10.0% by weight, based on the toner.

External additives include inorganic particles and organic particles. Examples of a particulate inorganic compound include silicon dioxide, aluminum oxide, titanium oxide, zinc oxide, tin oxide, barium oxide and strontium titanate. Examples of a particulate organic compound include methacrylic acid ester polymer particles, acrylic acid ester polymer particles, styrene-methacrylic acid ester copolymer particles, and styrene-acrylic acid ester copolymer particles. Metal soaps are cited as a lubricant and examples thereof include zinc stearate and calcium stearate.

Using a transmission electron microscope, external additives are observed to be contained in the toner, in the form of a single body or coagulate having a size of 10 to 300 nm. Preferably, external additives is treated with a silane coupling agent or a silicone oil to enhance hydrophobicity. The amount of an external additive to be added is not specifically limited but is preferably from 0.1% to 6% by weight. Two or more additives may be use in combination. A combination of inorganic particles differing in average particle size or a combination of different organic particles is suitable.

Figure 2:
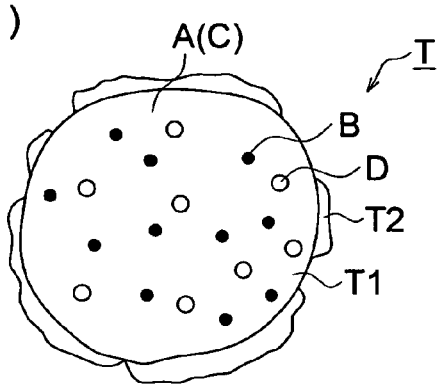
FIGS. 2(*a*) and 2(*b*) illustrate a structure of a toner particle.
Figure 2:
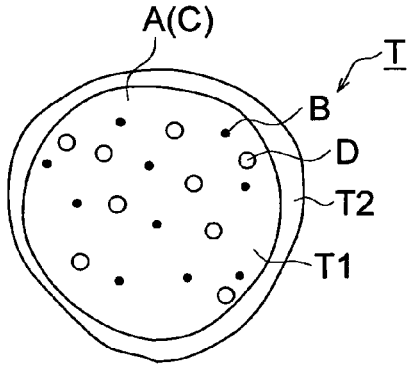

The structure of a toner particle relating to this invention will be concretely described with reference to drawings. Thus, FIGS. 2(*a*) and 2(*b*) illustrate a structure of a toner particle relating to this invention, in which T, A and B designate binding resin (A) and a colorant (B), respectively; C and D designate vinyl polymer (D) and releasing agent (E), respectively. As shown in FIGS. 2(*a*) and 2(*b*), toner particle T has a core/shell structure comprising a core portion (T1) and a shell portion (T2). The core portion (T1) contains resin (A), colorant (B), vinyl polymer (D) and releasing agent (E); the shell portion is formed of a resin containing no vinyl polymer (D).

In the invention, a toner is manufactured preferably by a polymerization method rather than a pulverization method. From the viewpoint of offset printing, it is contemplated that in a polymeric toner formed in an aqueous medium, a small amount of hydrophilic material existing on the toner surface, such as a surfactant or water, promotes adhesion of toner onto the surface of offset printing sheet.

The toner particle (T) may be one in which a part of the core surface is covered with a shell, as shown in FIG. 2(*a*), or one in which the whole core surface is covered with a shell, as shown in FIG. 2(*b*). A toner particle having such a core/shell structure and containing a vinyl polymer (D) enables compatibility of fixability at a lower heating temperature and superior storage stability.

In one preferred embodiment of this invention, a toner which contains toner particles relating to this invention is prepared by a process comprising flocculating resin particles (s) containing a vinyl polymer (D) to form a core and allowing resin particles (t) to adhere onto the core surface to form a shell. A method of preparing a toner will be further described below. Hereinafter, resin particles (s) containing vinyl polymer (D) is also denoted as particulate core resin (s) or simply as particulate resin (s). Resin particles (t) covering the core to form a shell is also denoted as particulate shell resin (t) or simply as particulate resin (t). The particulate shell resin (t) does not necessarily-contain a vinyl polymer (D).

Emulsion Aggregation

A method of forming a core by flocculating resin particles (s) containing a vinyl polymer (D) is preferably a so-called emulsion coagulation method which comprises flocculating resin particles (s) in an aqueous medium to allow them to fuse. The aggregation refers to a preparation method of allowing resin particles to flocculate and fuse in an aqueous medium. The expression "fuse" means uniting plural resin particles per a toner particle. It is preferred to allow flocculation and fusion to proceed concurrently. Alternatively, after completing flocculation, a fusing step may be provided.

Examples of a method of flocculating resin particles include a salting-out method in which metal salts are used as a flocculant (also called a salting-out agent), a method in which dispersion stability is lowered by adding nonionic surfactants with increasing the temperature, a method of using organic solvents, and a method of allowing a reactive pre-polymer to react. In this invention, the method of flocculating resin particles (s) is not specifically limited but the salting-out method is preferred in terms of superior transferability onto offset printing paper.

Particulate core resin (s) can be prepared by an emulsion polymerization method, a mini emulsion polymerization method or a method in which a resin solution is emulsified, followed by removal of the solvent. Of these, an emulsion polymerization method or a mini-emulsion polymerization method is preferred, in which formation of particles having a multiple layer structure is easily performed through multi-stage polymerization. A resin (A) is prepared preferably by performing polymerization in the presence of a vinyl polymer (D). In one preferred embodiment, a polymerizable monomer for the resin (A) is polymerized together in an aqueous medium having an oil phase containing a vinyl polymer (D) and a releasing agent (E) and then, colorant (B) is associated therewith.

The emulsion aggregation has the advantage that the particle size distribution is sharp (or narrow) and the shape or particle size of a toner can be easily controlled. For instance, a toner having a particle size of 5 μm is prepared in such a manner that flocculation of resin particles proceed by way of growth to 3 μm, 4 μm and 5 μm with the elapse of time and when reaching 5 μm, a flocculation terminator is added thereto to stop flocculation to obtain final particles. Cessation of flocculation is conducted by addition of the metal salt having a valence number less than that of a metal salt used for flocculation (for instance, potassium chloride or the like when aluminum sulfate is used as a flocculant), by addition of a surfactant or by dilution with distilled water, whereby the toner particle size is fixed. Thereafter, as a shape control step, stirring is continued at a temperature higher than the glass transition temperature of the resin particles to round the toner shape. When reached an intended shape, the temperature of an aqueous medium is lowered to stop the reaction. Alternatively, while stirring is continued at a temperature higher than the glass transition temperature of the resin particles, shearing stress applied to a toner is enhanced by increasing stirring power to control the shape with promoting deformation.

Mini-Emulsion Polymerization

Resin particles (s) containing a vinyl polymer (D) are preferably prepared by adding the vinyl polymer (D) to a monomer emulsion dispersed in an aqueous medium to perform mini-emulsion polymerization. Thus, in an aqueous medium in which a surfactant is dissolved at a concentration less than its critical micelle concentration, a solution of resin (A) in which vinyl polymer (D) is dissolved, is dispersed in the form of oil droplets employing mechanical energy to prepare a dispersion. To the thus prepared dispersion, a water-soluble polymerization initiator is added to undergo radical polymerization within the oil droplets (which is called mini-emulsion polymerization or a mini-emulsion method). In the foregoing method, the water-soluble polymerization initiator may be replaced by an oil-soluble polymerization initiator together with the water-soluble polymerization initiator Since the mini-emulsion polymerization method performs resin formation with mechanically dispersing oil droplets in an aqueous medium, vinyl polymer (D) is efficiently compounded with a monomer, rendering its release from the oil phase difficult. As a result, the vinyl polymer (D) can be introduced into the formed resin particles (s). A dispersing machine which performs oil-droplet dispersion by employing mechanical energy, is not specifically limited and examples thereof include a stirring apparatus provided with a high-speed rotor, such as CLEARMIX (produced by M Technique Co.), an ultrasonic dispersing machine, a mechanical type homogenizer, a Manton-Gaulin homogenizer and a pressure-type homogenizer. The average particle size of dispersed oil droplets is preferably 10 to 1000 nm, more preferably 50 to 1000 nm, and still more preferably 30 to 300 nm.

The thus prepared particles to be toner containing solution is subjected to solid-liquid separation using conventionally known centrifugal dehydrators or a decanter and the particle to be toner is washed. The washing water temperature is preferably from 20 to 50° C., and more preferably 35 to 45° C. The washed particles to be toner is dried using flash dryer or a fluidized-bed dryer known in the art, or their modified dryers. The drying temperature is preferably from 20 to 50° C., and more preferably 35 to 45° C.

External additives are added to the obtained particles to be toner. Addition of external additives is conducted by charging external additives together with particles to be toner into a HENSCHEL MIXER (Produced by Mitsui Miike Kako Co., Ltd.) with stirring. The mixing temperature is preferably from 20 to 35° C., the mixing time is preferably from 5 to 30 min. and the circulation speed of a stirring blade is preferably from 20 to 45 m/s.

The toner of this invention is usable as a one-component developer or a two-component developer. Examples of a one-component developer include a nonmagnetic one-component developer and a magnetic one-component developer which contains magnetic particles of 0.1 to 0.5 μm. The two-component developer is obtained by mixing a toner and a carrier. Iron-containing magnetic particles are used as a carrier. The volume-average particle size of the foregoing magnetic particles is preferably from 15 to 100 μm. A toner and a carrier are mixed so that a toner concentration is from 3 to 20% of the developer, and stirred for 5 to 60 min using a V-type mixer or a double cone type mixer to prepare a two-component developer.

Image Forming Method

Toner images formed with the toner of this invention are subjected to fixation under heating and pressure and fixed on a recording sheet. Specifically, toner images formed on an offset printing paper sheet or the like are fixed by a roller-fixing method comprised of rollers or a belt-fixing method comprised of an endless belt which is entrained about a heat roller and a pressure roller. Of these, the belt-fixing method is preferred. There will be described a belt-fixing apparatus in the following.

Figure 3:
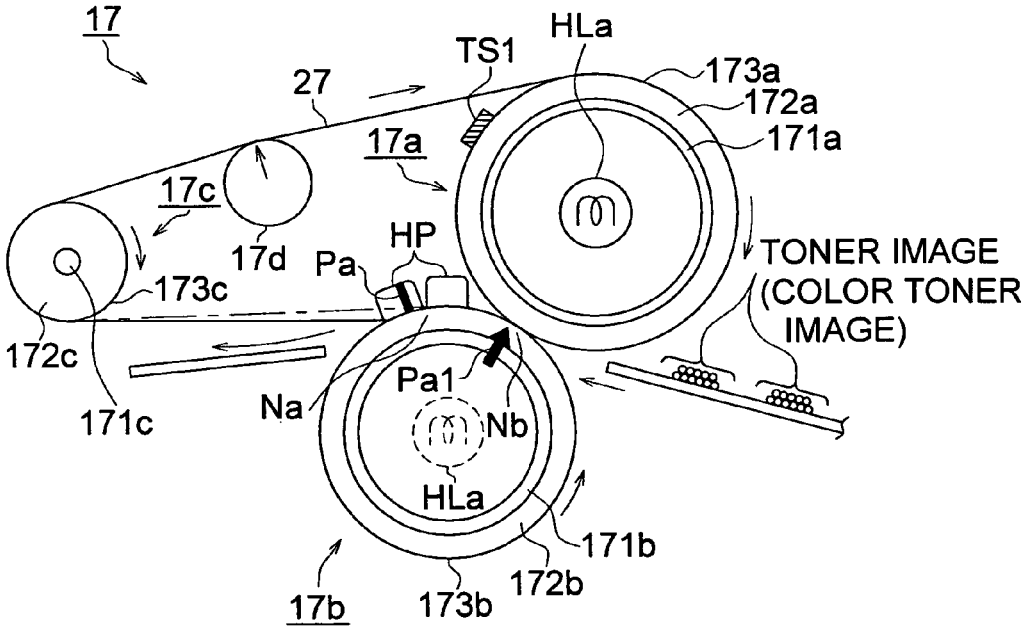
FIG. 3 illustrates an example of a belt fixing device.

FIG. 3 illustrates an example of a fixing apparatus for fixing images formed of the toner of this invention. The fixing apparatus comprises fixing belt 27 as an endless belt member, heat roller 17*a* as a first roller member about which the fixing belt 27 is entrained at one end of the fixing belt 27 (one of the inner periphery of the fixing belt 27), pressure roller 17*b* in contact with the heat roller 17*a* with sandwiching the fixing belt 27 therebetween, entraining roller 17*c* as a third roller member about which the fixing belt 27 is entrained at the other end of the fixing belt 27 (the other one of the inner periphery of the fixing belt 27) and plural roller members. Further, tension is applied to the fixing belt 27 by tension roller 17*d*.

Halogen lamp HLa, as a heat generator is provided in the interior of the heat roller 17*a* (sometimes even in the interior of the pressure roller 17*b*). Fixing nip portion Nb is formed between the heat roller 17*a* and the pressure roller 17*b* with sandwiching the fixing belt 27. Belt nip portion Na is formed between the fixing belt 27 and pressure roller 17*b*. Heat and pressure are applied via the fixing nip portion Nb and belt nip portion Na to fix toner images formed on recording paper P.

The fixing belt 27, for instance, uses a metallic belt such as an electroformed nickel belt as a substrate, the outer side (outer periphery) of which is covered with insulating silicone rubber; further thereon, fluororesin (PFA) is coated to form a releasing layer.

The heat roller 17*a* and the pressure roller 17*b* each comprise a rubber layer formed of silicone rubber on the outer periphery of a cylindrical metal pipe (171*a*, 171*b*) made of an aluminum material or a stainless steel material and fluororesin (PFA) is coated on the rubber layer (172*a*, 172*b*) to form a releasing layer (173*a*, 173*b*).

There will be described an image forming apparatus using a toner relating to this invention to perform image formation.

Figure 4:
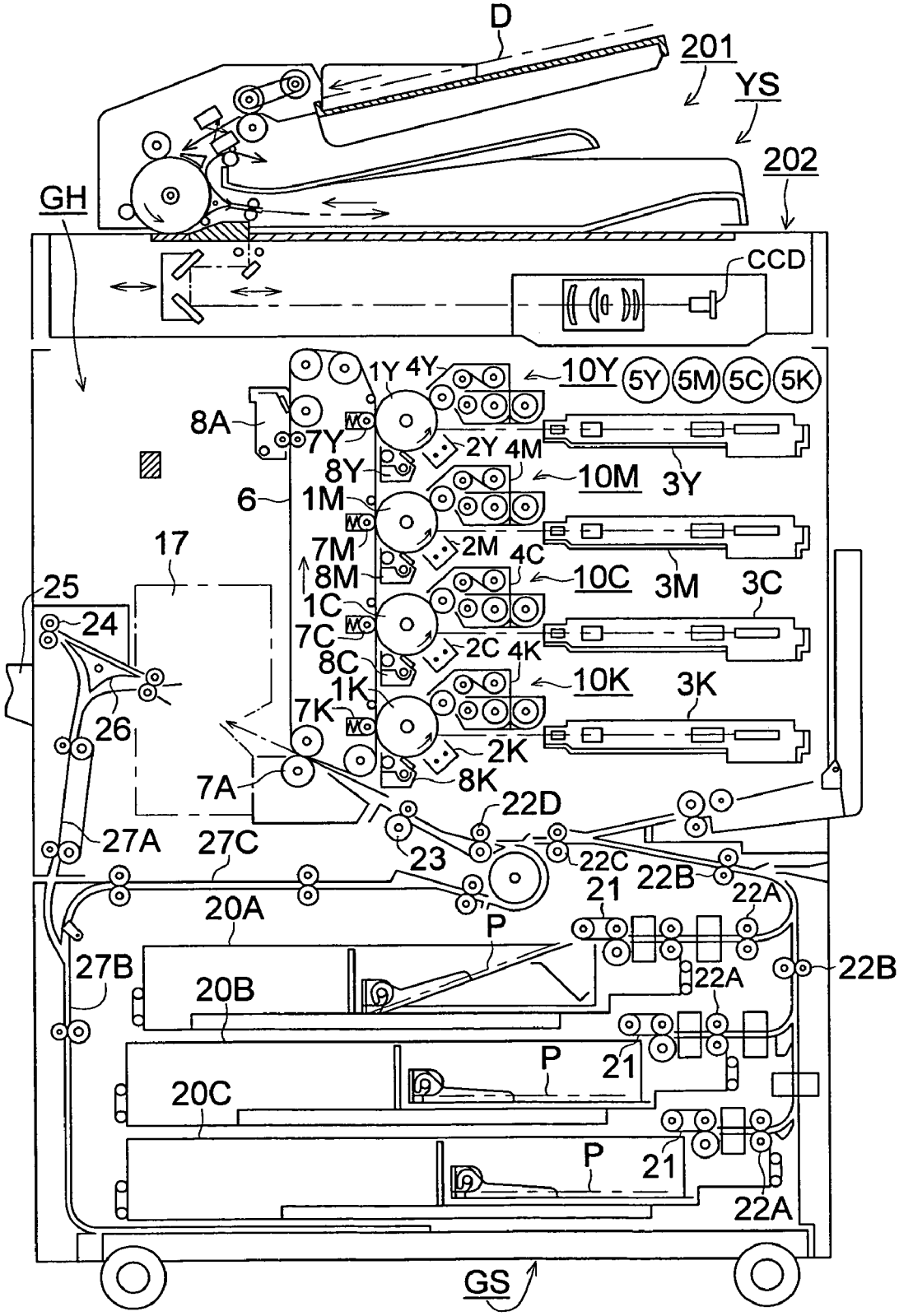
FIG. 4 illustrates an example of an image forming apparatus having a belt-type fixing device.

FIG. 4 illustrates an example of an image forming apparatus in which a toner relating to this invention is usable. Image forming apparatus GS is comprised of a main body GH of image forming apparatus and image reading device YS. The image reading device YS comprised of automatic manuscript feeding device 201 and manuscript image scanning exposure device 202 is provided in the upper section of the main body GH. A manuscript placed on a manuscript board of the automatic manuscript feeding device 201 is transported by a transporting means. Then, images on one side or both sides of the manuscript (D) are subjected to scanning exposure by an optical system of the manuscript image scanning exposure device 202 and read by a line image sensor CCD.

Analog signals which have been subjected to photoelectric conversion through the line image sensor CCD, are subjected to an analog treatment, A/D conversion, shading correction, image compression treatment and the like in the image processing section, and then transmitted to an image writing-in section (exposure means) 3Y, 3M, 3C and 3K.

The main body GH of the image forming apparatus shown in FIG. 4 is a so-called tandem type color image forming apparatus, which comprises plural image forming sections 10Y, 10M, 10C and 10K, intermediate transfer belt 6 of a belt-form intermediate transfer body, a fed paper conveyance means including re-feeding mechanism (ADU mechanism) and the foregoing fixing device 17 as a fixing means.

Image forming section 10Y forming a yellow (Y) image comprises photoreceptor drum 1Y as an image forming body, charging means 2Y, exposure means 3Y, developing device 4Y and image former cleaning means 8Y, as a toner image forming means, around the photoreceptor drum 1Y. Image forming section 10M, image forming section 10C and image forming section 10K perform magenta (M) image formation, cyan (C) image formation and black (K) image formation, respectively. The image forming sections 10M, 10C and 10D comprise photoreceptor drums 1M, 1C and 1B as an image forming body; charging means 2M, 2C and 2B; exposure means 3M, 3C and 3B; developing devices 4M, 4C and 4B and image former cleaning means 8M, 8C and 8B, as a toner image forming means, around the photoreceptor drums 1M, 1C and 1B, respectively. Charging means 2 and exposure means 3 constitute a latent image forming means. In developing device 4, reversal development is performed by applying development bias in which an ac voltage is superposed onto a dc voltage having the same polarity as a toner polarity. Toner will be replenished from toner storing means 5Y, 5M, 5C and 5K to developing devices 4Y, 4M, 4C and 4B.

Intermediate transfer belt 6 is entrained about plural rollers and rotatably supported.

The image forming process using the image forming apparatus shown in FIG. 4 is described as below.

The respective color images formed in the image forming sections 10Y, 10M, 10C and 10K, to each of which a primary transfer bias of an opposite polarity to the toner is applied by primary transfer rollers 7Y, 7M, 7C and 7B, are successively transferred onto an intermediate transfer belt 6. On the intermediate transfer belt 6 is formed a composite color image (color toner image).

Color images formed on the intermediate transfer belt 6 are all together transferred by secondary transfer roller 7A onto recording paper P which is supplied from feed paper cassette 20A, 20B or 20C by delivery roller 21 or feed roller 22A, 2B, 22C, 22D and 23. The toner remained on the intermediate transfer member is cleaned by cleaning means 8A. The recording paper having the transferred color image is subjected to a fixing treatment in fixing device 17 and conveyed onto discharge tray 25 while sandwiched between discharging rollers 24.

After completion of transfer, toners remained on the periphery of each of the photoreceptor drums are cleaned by image former cleaning means 8Y, 8M, 8C and 8B to enter the following image forming cycle. When the double face copies are formed, the switching member 26 switches the route to feed the paper to the direction of feeding path 27B. When paper is fed to the reversing member 27B, then the paper is reversed to feed feeding pass 27C. Then, the toner image will be transferred at the position of 7A after passing rollers 22D and 23. Then, the toner image on the paper is fixed at fixing device 17, and ejected to discharge tray 25.

To eject the paper so that a side having the last fixed toner image faces down, switching member 26 is switched so as to feed the paper to reversing member 27A, and the reversing member 27A feeds the paper towards roller 24 after the switching member 26 was set at the position to lead the paper to the roller 24.

Although the image forming apparatus shown in FIG. 4 concerns belt transfer, the toner relating to this invention is applicable to corona transfer or roller transfer. The intermediate transfer belt is preferably one having a structure of being entrained about plural rollers and rotatably supported, as shown in FIG. 4.

Glossy coated paper and nonglossy paper as representative paper usable in the toner relating to this invention and corresponding to offset printing will be described as follows.

Glossy coated paper for use in offset printing requires a high hydrophilic surface to promote wetting by an aqueous damping liquid used in printing. Resin emulsion such as wax having a melting point of 100 to 160° C. or acrylamide is coated on a paper substrate to form a glossy layer so that fibers or a filler is not released from the paper surface when wetted.

Glossy coated paper prepared by a casting method (in which paper having semi-dried coating material on raw paper, is pressed onto the mirror polished cylinder surface to prepare glossy coated paper) is representatively one of a structure having at least two electron beam-curable resin layers. In such glossy coated paper, cured material which is formed by exposing electron beam-curable resin composition containing no pigment to electron beams, is used in the inner layer; cured material which is formed by exposing electron beam-curable resin composition containing pigments to electron beams, is used in the outer layer. Glossy coated paper exhibits high surface whiteness and superior makeup.

Similarly to the foregoing glossy coated paper, nonglossy paper for use in offset printing requires a highly hydrophilic surface to promote wetting by an aqueous dampening liquid used in printing. Pharmaceutical chemicals, called paper-strengthening agents to provide strength to paper so that fibers or filler is released from the paper surface when wetted. Polyacrylamide is generally used as a paper-strengthening agent, including anionic polyacrylamide, cationic polyacrylamide and amphoteric polyacrylamide. Paper-strengthening agents are added typically in such a manner that a cationic polyacrylamide or an amphoteric polyacrylamide is singly added to a pulp slurry, or an anionic polyacrylamide and a cationic polyacrylamide are added in combination to a pulp slurry.

There is cited nonglossy paper exhibiting enhanced rupture strength, which is obtained by performing paper-making together with an additive which is prepared by copolymerization of acrylamide monomer, a vinyl monomer containing an anionic group and optionally a vinyl monomer containing a cationic group. There is also cited nonglossy paper which is coated with starch or polyvinyl alcohol as a paper-strengthening agent. Superior nonglossy paper can be obtained by the use of a coating solution having a content of polyvinyl alcohol as a paper-strengthening agent of at least 50% by weight and containing a penetrant such as a polyethylene glycol type nonionic surfactant in an amount of 10 to 10,000 ppm.

The weight of paper is preferably from 64 to 150 g/m$^2$.

EXAMPLES

The present invention will be described based on examples but embodiments of the invention are by no means limited to these.

Preparation of Vinyl Polymer (E)

Vinyl Polymer (E-1)

Vinyl polymer (E-1) was manufactured as below. Thus, reactant of 100% by weight of butyl acrylate (BA) was continuously supplied to a reactor similar to one shown in FIG. 1, including a continuous-stirring tank type reactor. The reaction zone weight and the supplying flow rate were controlled so that 100% of the usable volume of the continuous-stirring tank type reactor was filled with a polymerizable monomer and reactants and the average retention time was kept constant within the range of 10 to 15 min. Retention was adjusted so that the frequency of circulation was 16 times. The reaction temperature of the continuous-stirring tank type reactor was kept constant within a range of 200° C. The reaction product was continuously transferred via a pump to the volatile removing zone. A polymer product was continuously sampled in the volatile removing zone to determine a peal molecular weight and a glass transition point (Tg) and recovered through conduit 15. Thus obtained vinyl polymer was designated as vinyl polymer E-1. Vinyl polymer (E-1) exhibited molecular weight distribution having a peak at 1140 (i.e., a peak molecular weight of 1140) and a Tg of −71° C.

Vinyl Polymer (E-2)

Vinyl polymer (E-2) was manufactured by undergoing polymerization similarly to the foregoing vinyl polymer (E-1), except that 100% by weight of butyl acrylate was replaced by 100% by weight of 2-ethylhexyl acrylate (2-EHA) and the circulation number within the reactor was 24 times. Vinyl polymer (E-2) exhibited a molecular weight peak of 1760 and a Tg of −80° C.

Manufacture of Toner

Toner 1

1. Manufacture of Particulate Resin (s1)

A resin particle dispersion (S1) containing particulate resin (S1) for use in a surface which was to be adhered onto the host particle surface, was prepared as follows.

Preparation of Particulate Resin (1-1)

Polymerizable monomers were mixed to obtain polymerizable monomer solution (1-1-1), as below.

| | |
|---|---|
| Styrene | 70.1 g |
| n-Butylacrylate | 19.9 g |
| Methacrylic acid | 10.9 g |

In a 5,000 ml separable flask fitted with a stirrer, a temperature sensor, a condenser and nitrogen-introducing device, 7.08 g of anionic surfactant (102) was dissolved in 3010 g of deionized water and heated to an internal temperature of 80° C. with stirring in a stream of nitrogen to prepare a surfactant solution.

Surfactant (102): $C_{12}H_{25}OSO_3Na$

To the foregoing surfactant solution was added 9.2 g of a polymerization initiator (potassium persulfate, designated as KPS) dissolved in 200 g of deionized water and the temperature was maintained at 75° C. Further thereto, the monomer solution (1-1-1) was dropwise added for 1 hr. After completion of addition, the reaction mixture was stirred for 2 hr., with heating at 75° C. to perform polymerization (first step polymerization) to prepare particulate resin, which was designated as particulate resin (1-1-1) for surface. Resin forming this particulate resin exhibited a peak molecular weight at 35,000. The particulate resin exhibited a volume median diameter of 62 nm and the content of resin particles of a volume diameter of less than 36 nm was 0.4% in volume-based particle size distribution.

In a flask fitted with a stirrer, 96.0 g of a releasing agent (pentaerythritol tetrabehenate) was added to a mixture of polymerizable monomer as below and dissolved with heating at 80° C. to obtain polymerizable monomer solution (1-1-2):

| | |
|---|---|
| Styrene | 122.9 g |
| n-Butylacrylate | 49.7 g |
| Methacrylic acid | 16.3 g |

In a 5,000 ml separable flask fitted with a stirrer, a temperature sensor and a condenser, 5.7 g of anionic surfactant (101) was dissolved in 1340 g of deionized water and heated at a temperature of 80° C. with stirring to prepare a surfactant solution.

Surfactant (101): $C_{12}H_{25}(OCH_2CH_2)_2OSO_3Na$

After heating the surfactant solution to 80° C., the total amount of the particulate resin (1-1-1) was added thereto. Using a mechanical dispersing machine having a circulation path, CLEARMIX (produced by M-Technique Co., Ltd.), the monomer solution (1-1-2) was dispersed for 2 hrs. to obtain a dispersion (emulsion) containing emulsion particles (oil droplets) of particle size of 646 nm. The foregoing procedure was aimed at covering the particulate resin (1-1-1) with the monomer solution (1-1-2).

[104]

Subsequently, to the foregoing dispersion (emulsion) were added 1460 ml of deionized water and a initiator solution of 6.51 g of a polymerization initiator dissolved in 254 ml of deionized water and 0.75 g of n-octyl 3-mercaptopropionate. The mixture was stirred at 80° C. for 3 hrs. to perform polymerization (second step polymerization) to obtain resin particles, made from the particulate resin (1-1-1) for use in surface. The thus obtained resin particles were designated as particulate resin for surface (1-1-2).

To the particulate resin (1-1-2) was added an initiator solution of 8.87 g of a polymerization initiator (KPS) dissolved in 346 ml deionized water. Subsequently, a polymerizable monomer solution (1-1-3) as below was added dropwise for 1 hr. with heating at 80° C., which was aimed at the particle surface of the particulate resin (1-1-2) with the monomer solution (1-1-3).

| | |
|---|---|
| Styrene | 322.3 g |
| n-Butylacrylate | 121.9 g |
| Methacrylic acid | 35.5 g |
| n-octyl 3-mercaptopropionate | 19.8 g |

After completion of addition, the reaction mixture was stirred for 2 hrs. with heating to perform polymerization (third step polymerization) and then cooled to 28° C. to obtain a dispersion of particulate resin for surface (s1) made from the particulate resin for surface (1-1-2). The thus obtained particulate resin dispersion was designated as particulate resin dispersion (S1) for surface. This dispersion was sampled and dried to determine the glass transition temperature (Tg). Thus, using a differential scanning calorimeter, the temperature was increased to 100° C. and after allowed to stand for 3 min. at that temperature, the temperature was decreased to room temperature at a rate of 10° C./min. Subsequently, a sample was measured at a temperature-increasing rate of 10° C./min and then cooled to an extension of the base line below the glass transition temperature. Further, the temperature was increased again under the same conditions and the intersection with a tangent line of the base line after inflection was determined as a glass transition point (or temperature). The measurement was conducted using differential scanning calorimeter DSC-7, produced by Perkin Elmar. The particulate resin for surface (s1) exhibited a molecular weight peak at 35,000 and 17,000 in the molecular weight distribution and a weight-average molecular weight of 35,000.

2. Manufacture of Toner Host Particle 2-1. Manufacture of Particulate Resin

Particulate resin (1) as raw material for host particles was manufactured through two-step polymerization as follows.

In a flask fitted with a stirrer, 93.8 g of a releasing agent (pentaerythritol tetrabehenate) was added to a mixture of polymerizable monomer as below and dissolved with heating at 80° C. to obtain polymerizable monomer solution (2-1-1):

| | |
|---|---|
| Styrene | 186.9 g |
| n-Butylacrylate | 76.5 g |
| Methacrylic acid | 19.8 g |

In a 5,000 ml separable flask fitted with a stirrer, a temperature sensor and a condenser, 4.9 g of anionic surfactant (101) was dissolved in 1364 g of deionized water and heated at a temperature of 80° C. with stirring to prepare a surfactant solution.

Surfactant (101): $C_{12}H_{25}(OCH_2CH_2)_2OSO_3Na$

After heating the surfactant solution to 80° C., the total amount of the particulate resin (1-1-1) was added thereto. Using a mechanical dispersing machine having a circulation path, CLEARMIX (produced by M Technique Co., Ltd.), the monomer solution (2-1-1) was dispersed for 2 hrs. to obtain a dispersion (emulsion) containing emulsion particles (oil droplets) of particle size of 750 nm.

Subsequently, to the foregoing dispersion (emulsion) were added 1026 g of deionized water and a initiator solution of 9.8 g of a polymerization initiator dissolved in 381 ml of deionized water and 2.88 g of n-octanethiol. The mixture was stirred at 80° C. for 1.5 hrs. to perform polymerization (first step polymerization) to obtain resin particles (dispersion of high molecular weight resin particles). The thus obtained resin particles were designated as particulate resin for host (2-1-1).

To this particulate resin dispersion was added an initiator solution of 3.51 g of a polymerization initiator (KPS) dissolved in 137 ml deionized water. Subsequently, a polymerizable monomer solution (2-1-2) as below was added dropwise for 80 min. with heating at 80° C.

| Monomer solution (2-1-2) | |
|---|---|
| Styrene | 213.8 g |
| n-Butylacrylate | 69.4 g |
| n-Octanethiol | 4.55 g |
| Ethylideneacetic acid as alkylidenecarboxylic acid | 0.016 g |
| Vinyl polymer (E-1) | 1.7 g |

After completion of addition, the reaction mixture was stirred for 2 hrs. with heating to perform polymerization (second step polymerization) and then cooled to 28° C. to obtain a dispersion of particulate resin for host (2-1-2) made from the particulate resin for host (2-1-1).

2-2. Coagulation of Host Particles

Coagulation of colorant particles and the foregoing particulate resin for host was performed using a colorant dispersion as below and the composite resin particle dispersion described above.

Preparation of Colorant Dispersion 59.0 g of anionic surfactant (101) was dissolved in 1600 ml of deionized water with stirring. To the obtained solution, 420.0 g of carbon black (Regal 330) was gradually added and dispersed using CLEARMIX (produced by M Technique Co., Ltd.) to obtain a colorant particle dispersion. The average particle size of the colorant particle dispersion was 93 nm.

Coagulation 237.2 g (solids) of a dispersion of particulate resin for host (2-1-1), 2064 g of deionized water and 82 g of the foregoing colorant dispersion were placed into a four necked flask fitted with a temperature sensor, a condenser, a nitrogen-introducing device and a stirrer and stirred. After adjusting the internal temperature of the reaction vessel to 30° C., the pH was adjusted to 10 using an aqueous 5 mol/L sodium hydroxide solution.

Subsequently, 40.4 g of magnesium chloride hexahydrate dissolved in 40.4 ml of deionized water was added at 30° C. for 10 min. After allowed to stand for 3 min., heating was started and the temperature was increased to 85° C. for 60 min. to perform coagulation of the particulate resin (2-1-2) and colorant particles.

While stirring and heating, the particle size of host particles M1 was measured using Coulter Counter TA-II (produced by Beckman Coulter Co.). When the volume median diameter reached 5.5 μm, an aqueous solution of 5.1 g of sodium chloride dissolved in 20 ml of deionized water was added to inhibit grain growth to obtain host particles (m1).

Similarly to the particulate resin for surface (s1), the glass transition temperature (Tgm) of the host particles was measured and determined to be 28° C. Molecular weight was also measured using GPC (Gel permeation Chromatography). It was shown to have a molecular weight peak at 15,000 and a weight-average molecular weight of 22,000.

3. Dispersion of Toner 1

Adhesion of high-Tg resin particles onto host particles was performed as follows.

12.5 g (solids) of surface resin particle dispersion (S1) was adjusted to a pH of 8 using an aqueous 5 mol/L sodium hydroxide solution/The surface resin particle dispersion (S1) exhibited a ζ potential of −49.4 mV.

A host particle dispersion prepared in the foregoing coagulation was stirred with heating for 1 hr. and when reached a circularness degree of 0.936, the surface resin particle dispersion (S1) was added to allow the particulate resin (s1) to be adhered to the surface of host particles (M1).

After completion of addition of the particulate resin (s1), the circularness degree was proved to be 0.956. Thereafter, an aqueous solution of 96.3 g sodium chloride dissolved in 385 g deionized water, was added to weaken flocculation of particles and stirred with heating at 85° C. for 2 hr. to complete adhesion of particulate resin (s1) onto host particles (m1). Stirring and heating further continued until reached a desired circularization degree (circularness degree). Then, the dispersion was cooled to 30° C. at a rate of 8° C./min and the pH was adjusted to 2 with hydrochloric acid and stirring was stopped. A dispersion of toner 1 was thus obtained.

4. Solid/Liquid, Drying and External Addition

A dispersion of toner 1 was dehydrated using a centrifugal dehydrator, washed with spraying deionized water of 40° C. and then dried with hot air of 40° C. to obtain Particle 1.

To the thus obtained Particle 1, 0.8 part by weight of hydrophobic silica and 1.0 part by weight of hydrophobic titanium oxide, as external additives were added and mixed using a HENSCHEL MIXER at a circumferential blade speed of 30 m/sec over a period of 25 min. Toner 1 was thus prepared.

Toner 2

Similarly to the manufacture of the foregoing toner 1, toner 2 was obtained, provided that addition of 0.016 g of ethylideneacetic acid as alkylidenecarboxylic acid (C) and 1.7 g of vinyl polymer (E-1) was replaced by addition of 0.036 g of propylideneacetic acid and 1.7 g of vinyl polymer (E-2).

Toner 3

Similarly to the manufacture of the toner 1, toner 3 was obtained, provided that addition of 0.016 g of ethylideneacetic acid as alkylidenecarboxylic acid (C) was replaced by addition of 0.04 g of isopropylideneacetic acid.

Toner 4

Similarly to the manufacture of the toner 1, toner 4 was obtained, provided that addition of 0.016 g of ethylideneacetic acid as alkylidenecarboxylic acid (C) and 1.7 g of vinyl polymer (E-1) was replaced by addition of 0.044 g of butylideneacetic acid and 1.7 g of vinyl polymer (E-2).

Toner 5

Similarly to the manufacture of the toner 1, toner 5 was obtained, provided that addition of 0.016 g of ethylideneacetic acid as alkylidenedarboxylic acid (C) was replaced by addition of 0.04 g of isobutylideneacetic acid.

Toner 6

Similarly to the manufacture of the toner 1, toner 6 was obtained, provided that addition of 0.016 g of ethylideneacetic acid as alkylidenecarboxylic acid (C) and 1.7 g of vinyl polymer (E-1) was replaced by addition of 0.160 g of pentylideneacetic acid and 1.7 g of vinyl polymer (E-2).

Toner 7

Similarly to the manufacture of the toner 1, toner 7 was obtained, provided that addition of 0.016 g of ethylideneacetic acid as alkylidenecarboxylic acid (C) was replaced by addition of 0.04 g of isopentylideneacetic acid.

Toner 8

Similarly to the manufacture of the toner 1, toner 8 was obtained, provided that in the stage of manufacturing articulate resin as raw material for host particles, 0.016 g of ethylideneacetic acid was not added and in the stage of coagulation, 0.020 g of ethylideneacetic acid was added together with 237.2 g (solids) of a dispersion of particulate resin for host (2-1-2), 2064 g of deionized water and 82 g of the colorant-dispersion.

Toner 9

Similarly to the manufacture of the toner 1, toner 9 was obtained, provided that in the stage of manufacturing articulate resin as raw material for host particles, 0.016 g of ethylideneacetic acid was not added and 1.7 g of vinyl polymer (E-1) was replaced by 25.4 g of vinyl polymer (E-2), and in the stage of coagulation, 0.045 g of propylideneacetic acid was added together with 237.2 g (solids) of a dispersion of particulate resin for host (2-1-2), 2064 g of deionized water and 82 g of the colorant dispersion.

Toner 10

Similarly to the manufacture of the toner 1, toner 10 was obtained, provided that in the stage of manufacturing articulate resin as raw material for host particles, 0.016 g of ethylideneacetic acid was not added and in the stage of coagulation, 0.105 g of isopropylideneacetic acid was added together with 237.2 g (solids) of a dispersion of particulate resin for host (2-1-2), 2064 g of deionized water and 82 g of the colorant dispersion.

Toner 11

Similarly to the manufacture of the toner 1, toner 11 was obtained, provided that in the stage of manufacturing articulate resin as raw material for host particles, 0.016 g of ethylideneacetic acid was not added and 1.7 g of vinyl polymer (E-1) was replaced by 51.1 g of vinyl polymer (E-2), and in the stage of coagulation, 0.120 g of butylideneacetic acid was added together with 237.2 g (solids) of a dispersion of particulate resin for host (2-1-2), 2064 g of deionized water and 82 g of the colorant dispersion.

Toner 12

Similarly to the manufacture of the toner 1, toner 12 was obtained, provided that in the stage of manufacturing articulate resin as raw material for host particles, 0.016 g of ethylideneacetic acid was not added and in the stage of coagulation, 0.130 g of isobutylideneacetic acid was added together with 237.2 g (solids) of a dispersion of particulate resin for host (2-1-2), 2064 g of deionized water and 82 g of the colorant dispersion.

Toner 13

Similarly to the manufacture of the toner 1, toner 13 was obtained, provided that in the stage of manufacturing articulate resin as raw material for host particles, 0.016 g of ethylideneacetic acid was not added and 1.7 g of vinyl polymer (E-1) was replaced by 86.2 g of vinyl polymer (E-2), and in the stage of coagulation, 0.470 g of pentylideneacetic acid was added together with 237.2 g (solids) of a dispersion of particulate resin for host (2-1-2), 2064 g. of deionized water and 82 g of the colorant dispersion.

Toner 14

Similarly to the manufacture of the toner 1, toner 14 was obtained, provided that in the stage of manufacturing articulate resin as raw material for host particles, 0.016 g of ethylideneacetic acid was not added and in the stage of coagulation, 1.050 g of isopentylideneacetic acid was added together with 237.2 g (solids) of a dispersion of particulate resin for host (2-1-2), 2064 g of deionized water and 82 g of the colorant dispersion.

Toner 15

1000 parts by weight of powdery resin obtained by drying a dispersion of particulate resin for host (2-1-2) by a dryer, 100 parts by weight of carbon black and 150 parts by weight of a releasing agent (pentaerythritol tetrabehenate) were kneaded by a twin-screw extruding kneader, and pulverized and classified in a conventional manner to obtain a toner having a volume-based median diameter of 6.8 μm. Further thereto, 0.8 part by weight and 1.0 part by weight of hydrophobic titanium oxide were added and mixed for 25 min. by a HENSCHEL MIXER at a circumferential blade speed of 30 m/sec to obtain toner 15.

Toner 16 (for Comparison)

Similarly to toner 1, toner 16 was obtained, provided that neither ethylideneacetic acid nor vinyl polymer (E-1) was added.

Toner 17 (for Comparison)

Similarly to toner 1, toner 17 was obtained, provided that ethylideneacetic acid was replaced by butanoic acid.

Toner 18 (for Comparison)

Similarly to toner 7, toner 18 was obtained, provided that isobutylideneacetic acid was replaced by 4-methylpentanoic acid [$CH_3CH(CH_3)CH_2CH_2COOH$].

These toners 1-18 are shown in Table 1.

TABLE 1

| | Alkylidenecarboxylic Acid (C) | | | Vinyl |
|---|---|---|---|---|
| Toner No. | Compound | Addition Timing | Content*1 (%) | Polymer (E) |
| 1 | ethylideneacetic acid | Pol.*2 | 0.004 | E1 |
| 2 | Propylideneacetic acid | Pol. | 0.009 | E2 |
| 3 | isopropylideneacetic acid | Pol. | 0.01 | E1 |
| 4 | butylideneacetic acid | Pol. | 0.011 | E2 |
| 5 | isobutylideneacetic acid | Pol. | 0.012 | E1 |
| 6 | pentylideneacetic acid | Pol. | 0.04 | E2 |
| 7 | isopentylideneacetic acid | Pol. | 0.096 | E1 |
| 8 | ethylideneacetic acid | Coag.*3 | 0.008 | E1 |
| 9 | propylideneacetic acid | Coag. | 0.019 | E2 |
| 10 | isopropylideneacetic acid | Coag. | 0.021 | E1 |
| 11 | butylideneacetic acid | Coag. | 0.024 | E2 |
| 12 | isobutylideneacetic acid | Coag. | 0.026 | E1 |
| 13 | pentylideneacetic acid | Coag. | 0.094 | E2 |
| 14 | isopentylideneacetic acid | Coag. | 0.21 | E1 |
| 15 | isobutylideneacetic | Pulv.*4 | 0.487 | E1 |
| 16 | — | — | 0 | — |
| 17 | Butanoic acid | Pol. | 0.004 | E1 |
| 18 | 4-methylpentanoic acid | Pol. | 0.004 | E1 |

*1content (%, based on toner)
*2polymerization stage
*3coagulation stage
*4pulverization stage

Preparation of Developer

To each of the foregoing toners 1 to 18, a silicone resin-coated ferrite carrier having a volume-average particle size (median diameter) of 60 μm was added so as to have a toner concentration of 6% by weight and mixed to obtain developers 1 to 18.

Preparation of Offset Printing Paper

Offset printing paper for evaluation was prepared was prepared in the following manner and cut to A4 size.

Glossy Coated Paper

To 100 parts by weight of a pigment mixture which was comprised of 80 parts by weight of kaolin UW-90 (produced by Mongel Hard Co.) and 20 parts by weight of light calcium carbonate TAMA PEARL 123-SF (produced by Okutama Kogyo Co., Ltd.), 0.4 parts by weight of poly(sodium acrylate) was added and then dispersed in water using Deliter (produced by SERIE Co.) to prepare a pigment slurry at a solid content of 65% by weight. Subsequently, using the thus prepared pigment, a coating solution having the following composition as was prepared:

| Coating solution | |
|---|---|
| Pigment slurry as above (solid contents) | 80% by weight |
| Latex L-1537 (produced by Asahi Kasei Co.) | 15% by weight |
| Oxidized starch "Ace A" (produced by Oji Corn Starch Co.) | 2% by weight |
| Emulsified sizing agent SPW-116 (Arakawa Kagaku Kogyo Co., Ltd.) | 3% by weight |

To 100 parts by weight of solid contents of the foregoing coating solution were successively added 0.5 weight parts by weight of calcium stearate as a lubricant, 0.2 parts by weight of fluorescent dye, 0.2 parts by weight of a defoaming agent and water. After sufficiently stirred and mixed, the pH was adjusted using an aqueous 25% ammonia solution to obtain a water-based coating solution having a solid content of 60% by weight.

To a raw material mixture of 80% by weight of broadleaf kraft pulp (LBPK) exhibiting a freeness of 450 mlcsf (Canada Standard Freeness) and 20% by weight of needle tree kraft pulp (NBKP) exhibiting a freeness of 470 mlcsf, material described below were added in the following order. The expression "% by weight" means a absolute dry weight % for each material, based on absolutely dried pulp weight.

| | |
|---|---|
| Sizing agent SPS-300 (produced by Arakawa Kagaku Kogyou Co., Ltd.) | 0.90% by weight |
| Anionic PAM "polystron 194-7 (produced by Arakawa Kagaku Kogyou Co., Ltd.) | 0.18% by weight |
| Sulfuric acid band | 2.00% by weight |
| Amphoteric PAM Hermide EX-300F (produced by Harima Kasei Co., Ltd.) (anionic PAM:amphoteric PAM = 12:88) | 1.30% by weight |

The thus obtained stuff was diluted with water to a solid content of 0.6% and subjected paper-making by a conventionally known Fourdrinier paper machine. Further, a surface sizing agent having the following composition was coated at 2.0 g/m$^2$ using a size press and dried to obtain raw paper of a weight of 120 g/m$^2$.

| Surface sizing agent formula | |
|---|---|
| Enzyme-modified starch | 80% by weight |
| Polyvinyl alcohol T-330H (produced by Nippon Gosei Kagaku Kogyo Co.) | 17% by weight |
| Styrene acrylic acid type sizing agent Polymeron 1308S (produced by Arakawa Kagaku Kogyo Co. Ltd.) | 3% by weight |

The water-based coating solution was coated at 15 g/m$^2$ on one side of the raw paper, using "Blade Coater" (produced by Mitsubishi Jukogyo Co., Ltd.) and subsequently dried to a moisture content of 5.5% by weight, using Hot Air Dryer composed of four sections (arch-form hot air dryer, each drying length of 6 m, produced by Ishikawajima Harima Jukogyo Co., Ltd.). After completion of coating on the one side, coating and drying were similarly performed on the opposite side. Both side-coated paper having a weight of 150 g/m$^2$ was thus manufactured and wound up. Subsequently, two finishing apparatuses comprising a chilled roll exhibiting a surface temperature of 140° C. and an elastic urethane resin roll (exhibiting a shore D hardness of 61 degree). The foregoing dried, both side coated paper (wound up) was introduced to this finishing apparatus and passed therethrough so that both of the coated surfaces were each brought into contact with the chilled roll one time to perform finishing to manufacture the glossy coated paper. The linear nip pressure was 1,000 N/cm. The density of the thus obtained glossy coated paper was 1.01 g/cm$^3$ and the glossiness was 70%.

Determination of glossiness was conducted according to the method described in ISO 2813 (corresponding to JIS Z8741). Thus, using a measurement apparatus under measurement conditions described below, 15 portions having an area of 5 mm$^2$ were measured and an average value thereof was calculated.

Measurement Apparatus: Digital Glossmeter G-26D (produced by Murakami Shikisai Co.)

Measurement Conditions: 20 degrees, 60 degrees.

Nonglossy Paper

Leaf wood bleach kraft pulp (LBKP) was subjected to beating up to a freeness of 480 ml (Canada Standard Freeness, CSF). Further thereto, 0.2% by weight of synthetic sizing agent, SPS-300 (produced by Arakawa Kagaku Kogyou Co., Ltd.), 1.0% by weight of sulfuric acid band and 5% by weight of talc as an inorganic filler were added to prepare stuff. Using thus prepare stuff, paper making was conducted using Simformer wet paper-making machine, BALMET (produced by Sumitomo Juko Co., Ltd.) at a speed of 950 m/min. A coating solution comprising polyvinyl alcohol and a permeating agent and having a solids content of 5& by weight (in which 15 ppm of polyethylene glycol type nonionic surfactant High Roob D550, produced by Daiichi Kogyo Seiyaku Co., Ltd., was incorporated per solid content of polyvinyl alcohol P-7000, produced by Nippon Gosei Kagaku Kogyo Co., Ltd.) was coated on both sides of a paper base in a gate roll size press apparatus to prepare nonglossy paper (form paper) having a total coating amount of 0.55 g/m$^2$ and a weight of 64 g/m$^2$. The glossiness of the thus prepared nonglossy paper was determined to be 6%.

Evaluation

An electrophotographic printer BIZHUB PRO 1050 (associated machine having copier and scanner functions, produced by Konica Minolta Business Technology Inc.) was used as the evaluation apparatus, provided that the fixing device was changed to a belt fixing machine, as shown in FIG. 3.

Evaluation conditions were set for a speed of 105 sheet/min (at a cross-feed of A4 size) and a surface temperature of a heat roll of 120° C. Glossy coated paper (150 g/m$^2$) and nonglossy paper (64 g/m$^2$), manufactured above were used as a sheet (recording paper) for evaluation. Setting the surface temperature of a heat roll at 120° C. was based on the fact that when set at the said temperature, the surface temperature of an offset printing paper sheet discharged after fixing was confirmed to be 100° C. or less.

Image Evaluation

Fixing Property

A manuscript having 10 point characters over the whole surface of the sheet was used as a printed manuscript. This manuscript was printed on 250 sheets of individual evaluation sheets (glossy coated paper and nonglossy paper).

Printed evaluation sheets were turned over 10 time by a single thumb. Bleeding stain surrounding characters touched by the thumb and staining of the thumb were visually observed. Evaluation was made with respect to fixing property (fixability), based on the following criteria:

A: No blurred stain was noticed in characters on glossy coated paper and nonglossy paper (rated as superior), B: Slight blurred stains were noticed in characters on glossy coated paper but is acceptable in practice (rated as good), C: black blurred stains were noticed in characters on glossy coated paper and nonglossy paper, and the thumb was stained with toner (rated as poor).

Toner Blister

Nonglossy paper was used for the evaluation and a solid toner image was formed on nonglossy paper at a toner coverage of 1.6 mg/cm$^2$. Toner blister was visually evaluated with respect to the number of pores (toner blister) of 0.1 to 0.5 μm, generated in the solid toner image and the extent, based on the following criteria:

A: No toner blister was noticed (rated as superior),

B: 1 or 2 toner blisters per 4 cm$^2$ were observed but was considered an acceptable level in practice (rated as good), C: 3 or more toner blisters per 4 cm$^2$ were noticed and considered unacceptable in practice (rated as poor).

Retained Surface Glossiness of Coated Paper

Evaluation was made using a print manuscript having characters and photographic images at an image area ratio of 25% on both sides of glossy coated paper and the foregoing evaluation apparatus was also employed as an image forming apparatus.

Glossiness of the white background after fixing and that of a toner image area (solid area) were measured and the difference thereof was calculated. Glossiness of the toner image area was also evaluated in the same manner as described earlier (ISO 2813 or JIS Z8741). Capability of retaining surface glossiness was evaluated based on the following criteria:

A: glossiness of the white background was 68% to 72%, that of the toner image area was 68% to 74%, and the difference of 2% or less (rated as superior), B: glossiness of the white background was 65% to 75%, that of the toner image area was 64% to 78%, and the difference of 1% or less (rated as good), C: glossiness of the white background was 60% to 80%, that of the toner image area was 55% to 80%, and the difference being 1% or less (rated as acceptable practice), D: glossiness of the white background was 35% to 80%, that of the toner image area was 35% to 80%, and the difference being more than 10% (rated as unacceptable in practice).

Curling of Nonglossy Paper

Using a printed manuscript having characters and photographic images at an image area ratio of 25% on both sides of nonglossy paper and the foregoing apparatus for evaluation, image formation was performed under ordinary temperature and humidity (20° C., 55% RH) with cross-feeding recording sheets.

Curling was evaluated immediately after printing at ordinary temperature and humidity (20° C., 55% RH), according to the following procedure. Thus, a printed sheet was vertically hung, while supporting, by hand, the central portion (one point) of one edge in the flow direction of the sheet. The difference in length between the circular arc and both ends in the center of the hung lower edge (opposite edge to the supported edge, i.e., the height of the circular arc from the line connecting both ends of the lower edge, was determined in mm unit and defined as the curl value. It was confirmed that a curl value of less than 15 mm in an A4 size sheet caused no trouble in the process of offset printing.

Evaluation Criteria:

A: a curl value of less than 7 mm (rated as superior),

B: a curl value of not less than 7 mm and less than 10 mm (rated as good),

C: a curl value of not less than 10 mm and less than 15 mm (rated as acceptable in practice), D: a curl value of not less than 15 mm (rated as poor).

Uniformity in Transfer onto Nonglossy Paper

A printed image for evaluation was prepared in such a manner that a toner image of 5 cm×2 cm was formed on a photoreceptor at a toner coverage on the photoreceptor of 0.4 mg/cm$^2$, subsequently transferred onto nonglossy paper and then fixed.

The thus prepared printed image was visually evaluated by a panel of ten persons, based on the following criteria:

A: no person giving an answer as feeling unevenness in the toner image (rated as superior), B: one person giving an answer as feeling unevenness in the toner image (rated as good), C: two to four persons giving an answer as feeling unevenness in the toner image (rated as acceptable in practice), D: five or more persons giving an answer as feeling unevenness in the toner image (rated as poor).

Image Storage Stability

There were used glossy coated paper, as a evaluation sheet and two-sided photographic images having an image area ratio of 50%, as a printed original.

The printed original was printed onto both sides of glossy coated paper and 100 sheets of the printed paper were superposed and allowed to stand under conditions of high temperature and high humidity (33° C., 90% RH) for 72 hrs. to prepare printed images for evaluation.

Image storage stability of dual-side printed images was evaluated with respect to staining due to transfer of toner onto the front surface and the back surface of adjacent glossy coated paper, and paper handling property, based on the following criteria:

A: no staining due to toner transfer onto the front and back surfaces of adjacent glossy coated paper was observed, exhibiting enhanced paper handling ability (rated as superior), B: no staining due to toner transfer onto the front and back surfaces of adjacent glossy coated paper was observed, exhibiting slightly lowered handling ability (rated as good), C: slight staining due to toner transfer onto the front and back surfaces of adjacent glossy coated paper was observed but noticed only by a magnifier (rated as acceptable in practice), D: contacting sheets of glossy coated paper were adhered to each other due to a toner and forcedly peeling resulted in markedly staining due to toner transfer onto the front and back surfaces of contacting glossy coated paper (rated as poor).

Evaluation results are shown in Table 2.

TABLE 2

| | Toner | Fixability | Toner Blister | Surface Retaining*1 | Curling*2 | Uniformity in Transfer*3 | Image Storage Stability*4 |
|---|---|---|---|---|---|---|---|
| Example No. 1 | 1 | A | A | A | A | B | B |
| Example No. 2 | 2 | A | A | A | A | B | B |
| Example No. 3 | 3 | A | A | A | A | A | B |
| Example No. 4 | 4 | A | A | A | A | B | B |
| Example No. 5 | 5 | A | A | A | A | A | A |
| Example No. 6 | 6 | A | A | A | A | A | B |
| Example No. 7 | 7 | A | A | A | A | A | A |
| Example No. 8 | 8 | A | A | A | A | B | B |
| Example No. 9 | 9 | A | A | A | A | B | B |
| Example No. 10 | 10 | A | A | A | A | A | B |
| Example No. 11 | 11 | A | A | A | A | B | B |
| Example No. 12 | 12 | A | A | A | A | A | A |
| Example No. 13 | 13 | A | A | A | A | A | B |
| Example No. 14 | 14 | A | A | A | A | A | A |
| Example No. 15 | 15 | A | A | A | A | A | A |
| comp. 1 | 16 | D | C | D | D | C | C |
| comp. 2 | 17 | D | C | D | D | C | C |
| comp. 3 | 18 | D | C | D | D | C | C |

*1surface retaining of glossy paper
*2Curling of nonglossy paper
*3uniformity of transfer onto nonglossy paper
*4image storage stability of two-side print As can be seen from the results of Table 2, it was proved that examples 1 to 15 using toners 1 to 15, according to this invention fell within the acceptable range with respect to any one of evaluation criteria. On the contrary, comparative examples 1 to 3 resulted in falling outside the acceptable range with respect to at least one of evaluation criteria, producing problems in practical use. Thus, it was found that the use of a toner according to this invention achieved superior image formation when using offset printing paper sheets.

In the examples 1 to 15, toner image formation onto offset printing paper can be stably achieved. Thus, after a toner image is transferred onto a sheet of offset printing paper, fixing is feasible at a relatively low temperature of less than 100° C., thereby inhibiting so-called toner blister, i.e., an image defect due to water vapor generation during fixing. In the examples 1 to 15, occurrence of the curl after the toner image was fixed on the offset printing paper, can be protected. Thereby, stable toner image forming on the non-coated paper can be obtained. It became possible to obtain stable glossiness on the white background after thermally fixing the glossy coated paper having toner image. Further, it became possible to provide stable toner image forming and transfer property without transfer irregularity to the offset printing paper having affinity to water. Still, it became possible to provide stable toner image forming even if under high temperature and humidity, to provide toner image preservation property that prints are not polluted by toner images had by each other, and to realize on-demand printing by electrophotographic image forming.

What is claimed is:

1. An electrophotographic toner comprising a resin (A), a colorant (B) and an alkylidenecarboxylic acid (C).

2. The toner of claim 1, wherein the alkylidenecarboxylic acid (C) is an alkylidenecarboxylic acid having a total carbon atoms of 4 to 12.

3. The toner of claim 1, wherein the alkylidenecarboxylic acid (C) is contained in an amount of 0.0002% to 0.5% by weight of the toner.

4. The toner of claim 1, wherein the alkylidenecarboxylic acid (C) is isobutylideneacetic acid.

5. The toner of claim 1, wherein the toner further comprises a releasing agent (E) and at least one of a (meth)acrylic acid ester polymer and a (meth)acrylic acid ester-styrene copolymer exhibiting a peak molecular weight of 330 to 3400.

6. The toner of claim 5, wherein the (meth)acrylic acid ester polymer contains at least one of poly(butyl acrylate) and poly(2-ethylhexyl acrylate).

7. The toner of claim 5, wherein at least one of the (meth) acrylic acid ester polymer and (meth)acrylic acid ester-styrene copolymer is contained in an amount of 0.1 to 20 parts by weight, based on 100 parts by weight of the resin (A).

8. The toner of claim 5, wherein at least one of the (meth) acrylic acid ester polymer and (meth)acrylic acid ester-styrene copolymer exhibits a peak molecular weight of 800 to 2200.

9. The toner of claim 5, wherein at least one of the (meth) acrylic acid ester polymer and (meth)acrylic acid ester-styrene copolymer exhibits a peak molecular weight of 1000 to 1800.

10. The toner of claim 5, wherein the releasing agent comprises at least one of a polyethylene, polybutene, a paraffin wax, a microcrystalline wax and Fischer-Tropsch wax.

11. The toner of claim 10, wherein the toner is comprised of toner particles comprising a core and a shell, and the core comprises at least one of a (meth)acrylic acid ester polymer and a (meth)acrylic acid ester-styrene copolymer.

12. The toner of claim 5, wherein the toner comprises toner particles comprising a core and a shell, the core is formed by allowing particles of at least one of the (meth)acrylic acid ester polymer and (meth)acrylic acid ester-styrene copolymer to coagulate with each other and the shell is formed by allowing a particulate resin which does not contain at least one of the (meth)acrylic acid ester polymer and (meth)acrylic acid ester-styrene copolymer to adhere onto the core.

13. The toner of claim 1, wherein the toner is comprised of toner particles comprising a core and a shell.

14. The toner of claim 1, wherein the alkylidenecarboxylic acid (C) is an alkylideneacetic acid.

15. The toner of claim 14, wherein the alkylidenecarboxylic acid (C) has total carbon atoms of 4 to 12.

16. The toner of claim 15, wherein the toner contains the alkylidenecarboxylic acid (C) in an amount of 0.0002% to 0.5% by weight of the toner.

17. The toner of claim 15, wherein the toner contains the alkylidenecarboxylic acid (C) in an amount of 0.0004% to 0.16% by weight of the toner.

18. The toner of claim 1, wherein the alkylidenecarboxylic acid (C) is at least one selected from the group consisting of ethylideneacetic acid, propylideneacetic acid, isopropylideneacetic acid, butylideneacetic acid, isobutylideneacetic acid, pentylideneacetic acid and isopentylideneacetic acid.

* * * * *